US009038429B2

(12) United States Patent
Li et al.

(10) Patent No.: US 9,038,429 B2
(45) Date of Patent: May 26, 2015

(54) METHOD FOR MANUFACTURING GRAIN-ORIENTED SILICON STEEL WITH SINGLE COLD ROLLING

(75) Inventors: Guobao Li, Shanghai (CN); Pijun Zhang, Shanghai (CN); Yongjie Yang, Shanghai (CN); Kanyi Shen, Shanghai (CN); Zhuochao Hu, Shanghai (CN); Peiwen Wu, Shanghai (CN); Weizhong Jin, Shanghai (CN); Quanli Jiang, Shanghai (CN)

(73) Assignee: Baoshan Iron & Steel Co., Ltd., Shanghai (CN)

( * ) Notice: Subject to any disclaimer, the term of this patent is extended or adjusted under 35 U.S.C. 154(b) by 981 days.

(21) Appl. No.: 13/142,955

(22) PCT Filed: Dec. 31, 2009

(86) PCT No.: PCT/CN2009/076317

§ 371 (c)(1),
(2), (4) Date: Sep. 22, 2011

(87) PCT Pub. No.: WO2010/075797

PCT Pub. Date: Jul. 8, 2010

(65) Prior Publication Data

US 2012/0000262 A1 Jan. 5, 2012

(30) Foreign Application Priority Data

Dec. 31, 2008 (CN) ..... 2008 1 0205181

(51) Int. Cl.
*C21D 8/12* (2006.01)
(Continued)

(52) U.S. Cl.
CPC ... *C21D 8/12* (2013.01); *B21B 1/36* (2013.01); *B21B 3/00* (2013.01); *B21B 9/00* (2013.01);
(Continued)

(58) Field of Classification Search
CPC ..... B21B 1/36; B21B 3/00; B21B 3/003; B21B 9/00; B21B 45/004; B21B 45/0269; C21D 8/12; C21D 8/1255; C21D 8/1272
USPC ..... 72/199, 200, 202, 364, 365.2, 700; 148/111, 112, 113
See application file for complete search history.

(56) References Cited

U.S. PATENT DOCUMENTS 3,287,183 A * 11/1966 Taguchi et al. ..... 148/111
(Continued)

FOREIGN PATENT DOCUMENTS

CN 85100664 9/1986
(Continued)

*Primary Examiner* — Edward Tolan
(74) *Attorney, Agent, or Firm* — Hamre, Schumann, Mueller & Larson, P.C.

(57) ABSTRACT

The invention provides a method for producing grain-oriented silicon steel with single cold rolling, comprising: 1) smelting, refining and continuous casting to obtain a casting blank; 2) hot rolling; 3) normalization, i.e. normalizing annealing and cooling; 4) cold-rolling, i.e. single cold rolling at a cold rolling reduction rate of 75-92%; 5) decarburizing annealing at 780-880° C. for 80-350 s in a protective atmosphere having a due point of 40-80° C., wherein the total oxygen [O] in the surface of the decarburized sheet: 171/t≤[O]≤313/t (t represents the actual thickness of the steel sheet in mm), the amount of absorbed nitrogen: 2-10 ppm; 6) high temperature annealing, wherein the dew point of the protective atmosphere: 0-50° C., the temperature holding time at the first stage: 6-30 h, the amount of absorbed nitrogen during high-temperature annealing: 10-40 ppm; 7) hot-leveling annealing. The invention may control the primary recrystallization microstructure of steel sheet effectively by controlling the normalization process of hot rolled sheet to form sufficient favorable (Al, Si)N inclusions from nitrogen absorbed by slab during decarburizing annealing and low-temperature holding of high-temperature annealing, facilitating the generation of stable, perfect secondary recrystallization microstructure of the final products. In addition, the invention avoids the impact of nitridation using ammonia on the underlying layer in prior art, and thus the formation of a good glass film underlying layer is favored.

8 Claims, 2 Drawing Sheets

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/16*** | (2006.01) |
| ***H01F 1/147*** | (2006.01) |
| *B21B 1/36* | (2006.01) |
| *B21B 3/00* | (2006.01) |
| *B21B 9/00* | (2006.01) |
| *C21D 1/28* | (2006.01) |

(52) U.S. Cl.

CPC ..... *C21D 1/28* (2013.01); *C21D 8/1255* (2013.01); *C21D 8/1272* (2013.01); *C21D 9/46* (2013.01); *C22C 38/001* (2013.01); *C22C 38/008* (2013.01); *C22C 38/02* (2013.01); *C22C 38/04* (2013.01); *C22C 38/06* (2013.01); *C22C 38/16* (2013.01); *H01F 1/14775* (2013.01)

(56) References Cited

U.S. PATENT DOCUMENTS

| | | | | |
|---|---|---|---|---|
| 4,115,161 | A * | 9/1978 | Datta | 148/111 |
| 4,318,758 | A * | 3/1982 | Kuroki et al. | 148/111 |
| 4,588,453 | A * | 5/1986 | Shimizu et al. | 148/111 |
| 4,997,493 | A * | 3/1991 | Ushigami et al. | 148/111 |
| 5,082,509 | A * | 1/1992 | Ushigami et al. | 148/111 |
| 6,273,964 | B1 | 8/2001 | Fortunati et al. | |
| 6,296,719 | B1 | 10/2001 | Fortunati et al. | |
| 8,177,920 | B2 * | 5/2012 | Shingaki et al. | 148/113 |

FOREIGN PATENT DOCUMENTS

| | | |
|---|---|---|
| CN | 88101506.7 | 9/1989 |
| CN | 1228817 | 9/1999 |
| CN | 1231703 | 10/1999 |
| CN | 1242057 | 1/2000 |
| CN | 1244220 | 2/2000 |
| CN | 100381598 | 4/2008 |
| EP | 0420238 | 4/1991 |
| JP | 01-230721 | 9/1989 |
| JP | 01-283324 | 11/1989 |
| JP | 03-211232 | 9/1991 |
| JP | 05-112827 | 5/1993 |

* cited by examiner

METHOD FOR MANUFACTURING GRAIN-ORIENTED SILICON STEEL WITH SINGLE COLD ROLLING

TECHNICAL FIELD

The invention relates to a method for manufacturing grain-oriented silicon steel, particularly to a method for manufacturing grain-oriented silicon steel with single cold rolling.

BACKGROUND ART

Conventionally, grain-oriented silicon steel is manufactured by the following process, wherein:

Steel is secondarily refined and alloyed in a converter (or an electric furnace), and then continuously cast into slab, the basic chemical composition of which includes Si (2.5-4.5%), C (0.01-0.10%), Mn (0.03-0.1%), S (0.012-0.050%), Als (0.01-0.05%) and N (0.003-0.012%), in some instances further comprising one or more elements of Cu, Mo, Sb, Cr, B, Bi and the like, balanced by iron and some unavailable inclusions;

The slab is heated to about 1400° C. in a special-purpose high-temperature heater and kept at this temperature for more than 30 minutes to sufficiently solid dissolve favorable inclusions, so that dispersed fine particles of secondary phase, namely inhibitor, precipitate in the silicon steel matrix during subsequent hot rolling; after or without normalization, the hot rolled sheet is scrubbed with acid to remove iron scale from its surface; the sheet is rolled to the thickness of the final product with single cold rolling or more than two cold rollings with annealing therebetween, coated with an annealing separator comprising MgO as the main component, and then decarburizing annealed to lower [C] in the steel sheet to a level not influencing the magnetism of the final product (typically lower than 30 ppm); physical and chemical changes such as secondary recrystallization, formation of $Mg_2SiO_4$ underlying layer, purification (for removing elements harmful to magnetism, such as S, N, etc. in steel) and the like occur in the steel sheet during the high-temperature annealing process, giving grain-oriented silicon steel with high orientation and low iron loss; finally, after coated with insulating coating, stretched and annealed, grain-oriented silicon steel product ready for commercial use is obtained.

Conventional grain-oriented silicon steel exhibits the following notable characteristics:

(1) Since inhibitor is formed at the very beginning of the refining of steel and functions in subsequent procedures, it has to be controlled and regulated;

(2) The temperature up to 1400° C., at which the slab is heated, reaches the limit of a conventional heating furnace, and the control capability on the temperature drop of a rolling line also arrives at the limit of existing hot rolling technologies;

(3) The key of the production process is the control of the microstructure and texture of the steel sheet in each stage, and the behavior of the inhibitor;

(4) Heating at high temperature results in low utility of the heating furnace which needs frequent repair, high burning loss, large energy consumption, and severe edge cracking of the hot rolled coil, leading to difficulty in cold rolling procedure, low yield and high cost.

After half a century's development, the production technology of high-temperature grain-oriented silicon steel is well established and produces top-grade grain-oriented silicon steel products, contributing a lot to the development of electric and electronic industry. However, due to complicated production process, high technicality, serious inter-enterprise technical blockade, as well as special, narrow use of the technology and thus low total demand of the products, this technology is mastered by only a few steel manufacturers. On the other hand, heating at high temperature brings about a series of problems, for example, the need of special-purpose high-temperature heating furnace, poor practicality in production, high cost and the like.

In an attempt to solve these problems, some methods have been tried and developed successfully in long-time practice of production and research, which are described as follows.

(1) Method Using Electromagnetic Induction Heating

The method using electromagnetic induction heating, practiced by Nippon Steel Corp. and Kawasaki Steel Corp., is essentially one that heats slab at high temperature, except that, at the stage of heating slab at high temperature, $N_2$ and $H_2$ are introduced into the electromagnetic induction heating furnace as protective gases to control the atmosphere precisely, so that high-temperature oxidation of the slab is inhibited. Meanwhile, the fast heating rate in this method shortens the time for maintaining the furnace at high temperature. This method has solved the problem of edge cracking to a great extent. Specifically, an edge crack may be reduced to less than 15 mm, improving the producibility of grain-oriented silicon steel. Unfortunately, edge cracking can't be eliminated completely.

(2) Method for Producing Grain-Oriented Silicon Steel at Medium Temperature

A technology for producing grain-oriented silicon steel at medium temperature is adopted by VIZ, Russia, etc., wherein slab is heated at 1250-1300° C., the content of Cu in the chemical composition is relatively high, and AlN and Cu act as inhibitors. Similar to the case in the high-temperature method, the inhibitors herein are inherent too. The problem of edge cracking incurred by heating at high temperature may be avoided entirely in this method. However, as a drawback, this method can only be used to produce common grain-oriented silicon steel, rather than high magnetic induction grain-oriented silicon steel.

(3) Method for Heating Slab at Low Temperature in Japan

According to this method, slab is heated at a temperature lower than 1250° C., leading to no edge cracking and good producibility of hot rolled sheet. The inhibitors herein are acquired inhibitors, obtained by nitridation after decarburizing annealing. Thus, this method may be used to produce both common grain-oriented silicon steel and high magnetic induction grain-oriented silicon steel.

(4) CSP Method for Producing Oriented Silicon Steel

This method has also tackled the problem of edge cracking during hot rolling oriented silicon steel, improving producibility while lowering production cost. The inhibitors herein are acquired ones too, obtained by nitridation.

It is obvious that heating slab at low temperature stands for the developmental trend of the technology for producing grain-oriented silicon steel, for it overcomes the innate drawback suffered by heating slab at high temperature, improves producibility and lowers cost.

For example, a method for producing grain-oriented silicon steel at low temperature in Japan is described in Japanese Patent Publication Heisei 3-211232. In this patent, chemical composition 1 comprises [C] 0.025-0.075%, Si 2.5-4.5%, S≤0.015%, Als 0.010-0.050%, N≤0.0010-0.0120%, Mn 0.05-0.45%, Sn 0.01-0.10%, balanced by Fe and unavailable inclusions. After heated at a temperature lower than 1200° C., the slab is hot rolled, and then rolled to the thickness of the final product with single cold rolling or more than two cold rollings with annealing therebetween at a cold rolling reduction rate of over 80%. Subsequently, the resultant sheet is decarburizing annealed and high-temperature annealed, during which nitridation is carried out once secondary recrystallization begins.

Chemical composition 2 comprises [C] 0.025-0.075%, Si 2.5-4.5%, S≤0.015%, Als 0.010-0.050%, N≤0.0010-0.0120%, B 0.0005-0.0080%, Mn 0.05-0.45%, Sn 0.01-0.10%, balanced by Fe and unavailable inclusions. After heated at a temperature lower than 1200° C., the slab is hot rolled, and then rolled to the thickness of the final product with single cold rolling or more than two cold rollings with annealing therebetween at a cold rolling reduction rate of over 80%. Subsequently, the resultant sheet is decarburizing annealed and high-temperature annealed, during which nitridation is carried out once secondary recrystallization began.

After decarburizing annealing, oxygen content of the steel sheet may be converted to that of a 12 mil sheet: $[O]_{ppm}=55t\pm50$ (t: sheet thickness in mil). This method may be used to produce high electromagnetic induction grain-oriented silicon steel.

In a method described in Japanese Patent Publication Heisei 5-112827, the chemical composition comprises [C] 0.025-0.075%, Si 2.9-4.5%, S≤0.012%, Als 0.010-0.060%, N≤0.010%, Mn 0.08-0.45%, P 0.015-0.045%, balanced by Fe and unavailable inclusions. After heated at a temperature lower than 1200° C., the slab is hot rolled, and then rolled to the thickness of the final product with single cold rolling or more than two cold rollings with annealing therebetween. After decarburizing annealing, the resultant sheet is continuously nitrided while it advances. After coated with a separator, it is annealed at high temperature, producing grain-oriented silicon steel having good magnetism and underlying layer quality. In the nitriding process, the protective atmosphere is a gas mixture of $H_2$ and $N_2$, the content of $NH_3$ is over 1000 ppm, the oxygen potential is $pH_2O/pH_2\leq0.04$, and the nitriding temperature is 500-900° C.

During high-temperature annealing, the atmosphere is kept weakly oxidative at 600-850° C.

In a method of Acciai Speciali Terni Spa for producing grain-oriented silicon steel at low temperature as described in Chinese Patent CN1228817A, the chemical composition comprises Si 2.5-5%, C 0.002-0.075%, Mn 0.05-0.4%, S (or S+0.503Se)<0.015%, acid soluble Al 0.010-0.045%, N 0.003-0.013%, Sn≤0.2%, balanced by Fe and unavailable inclusions. The steel of the above composition is cast into thin slab, which is then heated at 1150-1300° C. After hot rolling, the slab is normalizing annealed and subjected to final cold rolling at a reduction rate of 80%. When final high-temperature annealing is carried out, the annealing atmosphere is controlled to keep the content of absorbed nitrogen by the steel lower than 50 ppm. This method doesn't use nitriding process, mainly suitable for producing grain-oriented silicon steel by continuously casting thin slab.

In a method disclosed in Chinese Patent CN1231703A, the chemical composition is a low carbon system containing copper. The production process is substantially consistent with the forgoing patent except that the steel sheet is nitrided at 900-1050° C. at a nitriding amount of less than 50 ppm after decarburizing annealing. This method is suitable for the production of grain-oriented silicon steel from thin slab.

In another method disclosed in Chinese Patent CN1242057A, the chemical composition comprises Si 2.5-4.5%; C 150-750 ppm, most preferably 250-500 ppm; Mn 300-4000 ppm, most preferably 500-2000 ppm; S<120 ppm, most preferably 50-70 ppm; acid soluble Al 100-400 ppm, most preferably 200-350 ppm; N 30-130 ppm, most preferably 60-100 ppm; Ti<50 ppm, most preferably less than 30 ppm, balanced by Fe and unavailable inclusions. Slab is heated at 1200-1320° C. and nitrided at 850-1050° C. The other procedures are substantially the same as the above two patents.

Still another method disclosed in Chinese Patent CN1244220A features simultaneous nitridation and decarburization.

The key point of other patents is the existence of precipitated dispersed phase in hot rolled sheet, facilitating high-temperature nitridation at 900-1000° C. It may be summarized that the low-temperature technology of Acciai Speciali Terni Spa is limited to high-temperature nitridation and/or production of grain-oriented silicon steel by continuously casting thin slab. The main point lies in the existence of precipitated dispersed phase in hot rolled sheet, which is favorable for high-temperature nitridation that is carried out concurrently with or after decarburization.

The chemical composition of the low-temperature grain-oriented silicon steel developed by POSCO, South Korea, comprises C 0.02-0.045%, Si 2.9-3.30%, Mn 0.05-0.3%, acid soluble Al 0.005-0.019%, N 0.003-0.008%, S<0.006%, Cu 0.30-0.70%, Ni 0.30-0.70%, Cr 0.30-0.70%, balanced by Fe and unavailable inclusions. In addition, the steel comprises 0.001-0.012% B. Decarburization is carried out at the same time with nitridation which occurs in moisture atmosphere. The basis of this method is the use of BN as the main inhibitor.

The methods described in Chinese patents such as Nos. 85100664 and 88101506.7 are all based on the conventional process wherein inhibitors are solid dissolved during heating and precipitation is controlled during rolling. The heating temperature actually approximates 1300° C., essentially different from the method of the present invention. The method described in Chinese Patent ZL200410099080.7 to Baosteel features nitridation before decarburization.

After consulting and analyzing relevant patents, references and the like on the technologies for producing grain-oriented silicon steel by heating slab at low temperature according to a nitriding process, it may be found that Japanese technologies focus on nitridation of steel sheet during the period from the end of decarburizing annealing to secondary recrystallization, and on the formation of inhibitors at the early stage of high-temperature annealing; European technologies are characterized by nitridation after or at the same time with decarburizing annealing, and by high nitriding temperature; POSCO technology is suitable for a composition system containing low carbon and low Al, wherein nitridation and decarburization are carried out concurrently.

When Japanese nitriding processes are used to produce grain-oriented silicon steel, growth of crystal grains formed during primary recrystallization can't be prevented due to the absence of inhibitors in steel sheet. The size of the crystal grains formed during primary recrystallization is controlled mainly by temperature and time. Thus, there is a high demand on the control of decarburizing annealing and nitriding process, and the process window is narrow. On the other hand, an oxide layer with $SiO_2$ as the main component has already formed on the steel sheet surface before nitridation is carried out after decarburizing annealing, so that the consistency and behavior of nitridation are liable to the interference of the oxide layer on the surface. The Acciai Speciali Terni Spa technology features high-temperature nitridation. To effect this process, slab has to be heated at a relatively high temperature, for example, about 1250° C., so that dispersed particles of second phase precipitate in hot rolled sheet as desired. Thus, favorable inclusions in the hot rolled sheet have to be controlled. In addition, nitridation is carried out after or at the same time with decarburizing annealing.

POSCO also adopts the process wherein decarburization and annealing are carried out concurrently. As a result, the oxide layer on the steel sheet surface has an unavailable impact on nitridation. Furthermore, the steel has a low content of Al, and BN is the main inhibitor. The instability of B will render the inhibiting capability of the inhibitor unstable, and the stability of magnetism will be affected to a great extent.

Table 1 compares the chemical composition systems of grain-oriented silicon steel produced by several technologies for heating slab at low temperature.

TABLE 1

Comparison among chemical composition systems unit: wt. %

| | C | Si | Mn | P | S | N | Als | Cu | Sn | B | Ni | Cr |
|---|---|---|---|---|---|---|---|---|---|---|---|---|
| Japan | 0.025-0.075 | 2.5-4.5 | 0.05-0.45 | 0.015-0.045 | ≤0.015 | 0.0010-0.0120 | 0.010-0.050 | / | 0.01-0.10 | 0.0005-0.0080 | / | / |
| AST | 0.002-0.075 | 2.5-5 | 0.05-0.4 | / | ≤0.015 | 0.003-0.013 | 0.010-0.045 | / | ≤0.2 | / | / | / |
| POSCO | 0.02-0.045 | 2.9-3.30 | 0.05-0.3 | / | <0.006 | 0.003-0.008 | 0.005-0.019 | 0.30-0.70 | / | 0.001-0.012 | 0.30-0.70 | 0.30-0.70 |
| The invention | 0.035-0.065 | 2.9-4.0 | 0.08-0.18 | 0.010-0.030 | 0.005-0.012 | 0.005-0.013 | 0.015-0.035 | 0.05-0.60 | 0.001-0.15 | / | / | ≤0.2 |

SUMMARY OF THE INVENTION

As described above, methods for producing grain-oriented silicon steel by heating slab at high temperature suffer from several inherent drawbacks such as high energy consumption, low utility of heating furnace, severe edge cracking of hot rolled sheet, poor practicality in production and low cost. Technologies for producing grain-oriented silicon steel by heating slab at low temperature may solve these problems well, and thus have been in development with strong momentum. Almost all technologies disclosed by current patents for producing grain-oriented silicon steel by heating slab at low temperature are based on nitriding process.

The object of the invention is to provide a method for producing grain-oriented silicon steel with single cold rolling, wherein sufficient amount of favorable inclusions (Al, Si)N are formed by controlling the normalization and cooling process of hot rolled sheet and making use of nitrogen absorption by slab during decarburizing annealing and low-temperature holding of high-temperature annealing. The inclusions function to refrain primarily recrystallized grains, and thus the primary recrystallization microstructure of steel sheet is controlled effectively. This facilities the generation of stable and perfect secondary recrystallization microstructure of the final product. Meanwhile, the invention avoids the blight of using ammonia during nitridation on the underlying layer and thus favors the formation of a superior glass film underlying layer.

For realization of the above object, the technical scheme of the invention is the use of a method for producing grain-oriented silicon steel with single cold rolling, comprising:

1) Smelting

After secondary refining and continuous casting of molten steel in a converter or an electric furnace, casting blank having the following composition based on mass is obtained: C 0.035-0.065%, Si 2.9-4.0%, Mn 0.08-0.18%, S 0.005-0.012%, Als 0.015-0.035%, N 0.0050-0.0130%, Sn 0.001-0.15%, P 0.010-0.030%, Cu 0.05-0.60%, Cr 0.2%, balanced by Fe and unavailable inclusions;

2) Hot Rolling

The casting blank is heated to 1090-1200° C. in a heating furnace. Rolling begins at a temperature below 1180° C. and ends at a temperature above 860° C. Hot rolled sheet of 1.5-3.5 mm is thus obtained and then coiled at 500-650° C.

3) Normalization

Normalizing annealing is carried out at 1050-1180° C. (1-20 s)+850-950° C. (30-200 s). Cooling is carried out at 10° C./s-60° C./s;

4) Cold Rolling

The sheet is rolled to the thickness of the final product with single cold rolling at a cold rolling reduction rate of 75-92%;

5) Decarburization

The steel sheet rolled to the thickness of the final product is decarburizing annealed at 780-880° C. for 80-350 s in a protective mixed gas atmosphere of $H_2$ and $N_2$ comprising 15-85% $H_2$. The dew point of the protective atmosphere is 40-80° C. The total oxygen [O] in the surface of the decarburized sheet is $171/t \leq [O] \leq 313/t$ (t represents the actual thickness of the steel sheet in mm). The amount of absorbed nitrogen is 2-10 ppm. Then the sheet is coated with a high-temperature annealing separator comprising MgO as the main component;

6) High-Temperature Annealing

The protective annealing atmosphere, comprised of a mixed gas of $H_2$ and $N_2$ or pure $N_2$ and having a dew point of 0-50° C., is controlled at a temperature below 1000° C. The holding time at the first stage is 6-30 h. The optimal low-temperature holding time for steel coil≥5 ton is 8-15 h. High-temperature annealing is carried out. The amount of absorbed nitrogen is 10-40 ppm;

7) Hot Leveling Annealing

A conventional hot leveling process is carried out.

On the basis of the foregoing basic composition, into the grain-oriented silicon steel may be further added 0.01-0.10% Mo and/or 0.2% Sb based on mass.

At ¼-⅓ and ⅔-¾ of the thickness of normalized sheet, the ratio of Gaussian texture (110)[001] to cubic texture (001)[110] is controlled to be $0.2 \leq I_{(110)[001]}/I_{(000)[110]} \leq 8$, preferably $0.5 \leq I_{(001)[110]} \leq 2$, wherein $I_{(110)[001]}$ and $I_{(000)[110]}$ are the intensities of Gaussian and cubic texture respectively. See FIG. 1.

Too large a proportion of crystal grains with Gaussian texture will be unfavorable to optimized growth, leading to decreased orientation of crystal grains after secondary recrystallization and thus an impact on magnetism. Too large a proportion of crystal grains with cubic texture will result in generation of a great deal of fine crystals of the same type in steel sheet after high-temperature annealing, leading to an impact on magnetism too. In addition, the sizes of inhibitors may be optimized by controlling cooling rate.

Furthermore, the number of crystal grains with Gaussian texture at ¼-⅓ and ⅔-¾ of the thickness of normalized sheet is not less than 5% of the total number of crystal grains.

The remarkable advantages of the method of the invention include:

(1) It has solved the inherent problems of the methods for producing grain-oriented silicon steel at high temperature, and lowered energy consumption and production cost. Additionally, since no special-purpose furnace is needed for heating slab at high temperature, the flexibility of production is increased greatly, and the productive capability of a hot rolling mill is not be restricted by a heating furnace. Therefore, promising benefit may be expected from this method.

(2) The content ranges of S and Cu to be controlled in chemical composition are made clear, ensuring steady precipitation of dispersed, fine inhibitors.

(3) The texture of crystal grains and the precipitation of part of inhibitors are optimized by adjusting the normalization process.

(4) Since special-purpose nitriding treatment of steel sheet using ammonia or any other nitriding agent is exempted, cost is lowered, and protection of environment is favored.

(5) Since ammonia is not used to carry out nitridation, impact of nitridation on the underlying layer is avoided, facilitating the formation of a good glass film underlying layer.

According to conventional processes for producing grain-oriented steel, casting blank has to be heated to 1350-1400° C. to solid dissolve the coarse precipitates of inhibitors such as MnS, AlN, etc. in the casting blank, so that MnS, AlN and the like may be formed finely and evenly during hot rolling or annealing of hot rolled sheet. Thus, conventional processes belong to a technology for heating slab at high temperature. In order to overcome the serious problems of oxidation, edge cracking and the like brought about by high-temperature heating, technologies for producing grain-oriented silicon steel by heating slab at low temperature have been developed, wherein acquired inhibitors are formed by nitridation. These technologies include the following types. One type, for example, Japanese Patent Publication Heisei 1-230721, Heisei 1-283324, etc., involves addition of chemical components for nitridation into a high-temperature annealing separator and formation of inhibitors such as (Al, Si)N and the like by nitriding steel band at the stage of high-temperature annealing. Another type involves nitridation with a nitriding atmosphere at the temperature rising stage of high-temperature annealing. These two types do not produce products with stable magnetism due to uneven nitridation among other reasons. On such a basis, another technology appears, which involves introduction of fairly active ammonia into the atmosphere during middle annealing, after decarburizing annealing or at the same time with decarburizing annealing. Ammonia is not used as the nitriding medium in the invention. In contrast to the foregoing patents, before the temperature rising stage of high-temperature annealing, the increase of nitrogen content in steel sheet mainly results from decomposition of nitrogen in the protective atmosphere in the stages of decarburizing annealing and low-temperature holding of high-temperature annealing.

In addition, a conventional continuous casting process is applied in the invention. Therefore, the invention is quite different from the processes for producing grain-oriented steel by continuously casting and rolling thin slab as disclosed in patents U.S. Pat. No. 6,273,964B1 and U.S. Pat. No. 6,296,719B1.

The patent of Acciai Speciali Terni Spa belongs to a technology of nitridation at high temperature, wherein nitridation is carried out after or at the same time with decarburization. Thus, it is different from the present invention. The methods described in Chinese Patents Nos. 85100664 and 88101506.7 are both based on the conventional process wherein inhibitors are solid dissolved during heating and precipitate under control during rolling, and the actual heating temperature appropriates 1300° C. Therefore, they are essentially different from the present invention.

By adjusting the normalization process of hot rolled sheet, the invention has realized optimization of the steel sheet texture and the amount of favorable inclusions after normalization. During decarburizing annealing, decarburization and precise control on the amount of oxygen in the steel sheet surface are achieved by controlling nitrogen/hydrogen ratio of the protective atmosphere, temperature, time and dew point to ensure formation of a good underlying layer. The control of nitrogen/hydrogen ratio of the protective atmosphere also effects absorption of nitrogen by the steel sheet. A suitable amount of inhibitors are obtained by controlling nitrogen/hydrogen ratio of the protective atmosphere at the low-temperature holding stage during high-temperature annealing to ensure perfect secondary recrystallization.

DETAILED DESCRIPTION OF THE INVENTION

Example 1

Figure 1:
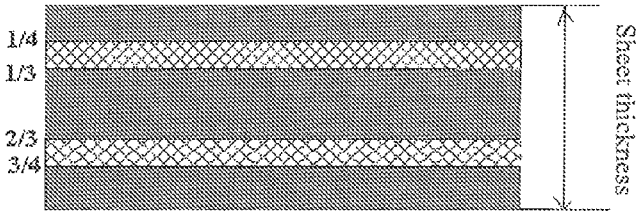
FIG. 1 is a schematic view showing the locations at ¼-⅓ and ⅔-¾ of the thickness of normalized sheet according to the invention.

Steel was smelted in a 500 kg vacuum furnace. The chemical compositions of and the hot rolling conditions for the steel are shown in Table 2 and 3. Normalization was carried out under the following conditions: 1130° C.×5 s+930° C.×70 s+50° C./s of cooling. The band steel was rolled to 0.30 mm. After decarburized and coated with MgO separator, the steel was subjected to high-temperature annealing and leveling annealing, coated with insulating coating, and measured for its magnetism. The results of cross-over experiments are shown in Table 4.

TABLE 2

Chemical compositions of experimental steel unit: %

| | C | Si | Mn | P | S | $Al_{sol.}$ | N | Cu | Sn |
|---|---|---|---|---|---|---|---|---|---|
| A | 0.057 | 3.85 | 0.13 | 0.020 | 0.0060 | 0.0275 | 0.0110 | 0.006 | 0.012 |
| B | 0.035 | 2.92 | 0.15 | 0.010 | 0.012 | 0.0153 | 0.0054 | 0.59 | 0.14 |

TABLE 3

Conditions for hot rolling experimental steel unit: ° C.

| | Heating Temperature | Temperature at the End of Rolling | Coiling Temperature | Thickness (mm) |
|---|---|---|---|---|
| C | 1160 | 900 | 500 | 2.5 |
| D | 1240 | 930 | 520 | 2.5 |

TABLE 4

Experimental Results

| | $B_8$ (T) | $P_{17/50}$ (W/kg) | Description |
|---|---|---|---|
| AD | 1.83 | 1.39 | Comparative Example |
| BC | 1.87 | 1.15 | Inventive Example |
| BD | 1.72 | 1.96 | Comparative Example |
| AC | 1.89 | 1.07 | Inventive Example |

Example 2

Composition A in Table 2 and hot rolling condition C in Table 3 were combined to carry out normalization experiments. The effect of normalization process condition 1120° C.×6 s+910° C.×X s+Y ° C./s on texture is shown in Table 5, and the relationship between normalization process condition and magnetism is shown in Table 6.

TABLE 5

Relationship between normalization process condition and texture ratio

| Description | X (Holding Time ) | Y (Cooling Rate ° C./s) | $I_{(110)[100]}/I_{(001)[110]}$ |
|---|---|---|---|
| Comparative Example | 20 | 30 | 0.12 |
| Inventive Example | 40 | 30 | 0.25 |
| Inventive Example | 190 | 30 | 7 |
| Comparative Example | 205 | 30 | 9 |
| Comparative Example | 70 | 9 | 0.01 |
| Inventive Example | 70 | 15 | 6 |
| Inventive Example | 70 | 58 | 1 |
| Comparative Example | 70 | 65 | 9.5 |

* Here, the number of crystal grains with Gaussian texture is not less than 5% of the total number of crystal grains.

TABLE 6

Relationship between normalization process condition and magnetism

| Description | B8 (T) | $P_{17/50}$(W/kg) |
|---|---|---|
| Comparative Example | 1.50 | 2.12 |
| Inventive Example | 1.84 | 1.34 |

TABLE 6-continued

Relationship between normalization process condition and magnetism

| Description | B8 (T) | $P_{17/50}$(W/kg) |
|---|---|---|
| Inventive Example | 1.85 | 1.25 |
| Comparative Example | 1.80 | 1.46 |
| Comparative Example | 1.77 | 1.87 |
| Inventive Example | 1.87 | 1.17 |
| Inventive Example | 1.90 | 1.06 |
| Comparative Example | 1.81 | 1.44 |

Example 3

Composition A in Table 2 and hot rolling condition C in Table 3 were combined to carry out normalization experiments. The effect of normalization process condition 1120° C.×5 s+910° C.×70 s+20° C./s, decarburizing time, temperature and dew point on magnetism and the underlying layer is shown in Table 7 and 8.

TABLE 7

Relationship between decarburizing temperature, time, dew point and magnetism

| Description | Decarburizing Time (s) | Decarburizing Temperature ° C. | Dew Point ° C. | Proportion of $N_2$ in Protective Atmosphere | $B_8$ (T) | $P_{17/50}$ (W/kg) |
|---|---|---|---|---|---|---|
| Comparative Example | 200 | 770 | +18 | 10% | 1.71 | 1.88 |
| Inventive Example | 200 | 790 | +40 | 55% | 1.84 | 1.34 |
| Inventive Example | 150 | 830 | +70 | 18% | 1.89 | 1.10 |
| Inventive Example | 250 | 850 | +60 | 50% | 1.87 | 1.18 |
| Inventive Example | 345 | 850 | +50 | 25% | 1.86 | 1.21 |
| Inventive Example | 90 | 870 | +77 | 80% | 1.85 | 1.23 |
| Comparative Example | 370 | 890 | +85 | 14% | 1.63 | 2.05 |
| Comparative Example | 150 | 900 | +19 | 88% | 1.51 | 2.41 |

TABLE 8

Relationship between decarburizing temperature, time, dew point and the underlying layer

| Description | Decarburizing Time (s) | Decarburizing Temperature ° C. | Dew Point ° C. | Proportion of $N_2$ in Protective Atmosphere | Nitrogen Increment ppm | Adhesion * (Grade) |
|---|---|---|---|---|---|---|
| Comparative Example | 200 | 770 | +18 | 10% | 1 | F |
| Inventive Example | 200 | 790 | +40 | 55% | 5 | C |
| Inventive Example | 150 | 830 | +70 | 18% | 3 | B |
| Inventive Example | 250 | 850 | +60 | 50% | 7 | A |
| Inventive Example | 345 | 850 | +50 | 25% | 7 | A |
| Inventive Example | 90 | 870 | +77 | 80% | 8 | B |

TABLE 8-continued

Relationship between decarburizing temperature, time, dew point and the underlying layer

| Description | Decarburizing Time (s) | Decarburizing Temperature ° C. | Dew Point ° C. | Proportion of $N_2$ in Protective Atmosphere | Nitrogen Increment ppm | Adhesion * (Grade) |
|---|---|---|---|---|---|---|
| Comparative Example | 370 | 890 | +85 | 14% | 9 | D |
| Comparative Example | 150 | 900 | +19 | 88% | 7 | F |

* With reference to GB/T2522-2007, Grade O > Grade A > Grade B > Grade C > Grade D > Grade E > Grade F. Grade E and higher are considered to be qualified.

Figure 2:
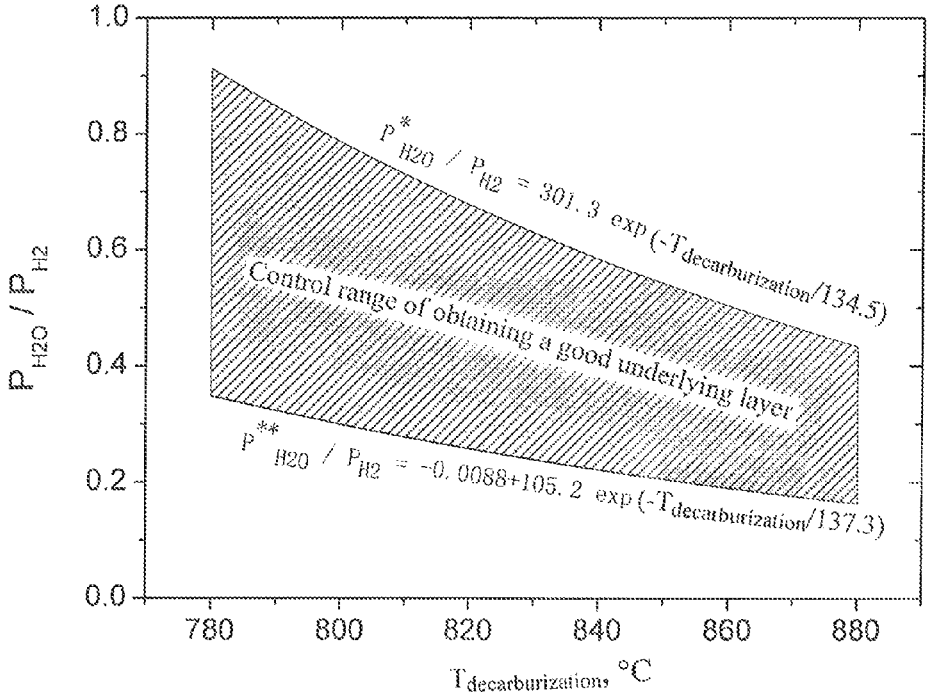
FIG. 2 is a diagram showing the control range of decarburization process for obtaining a good underlying layer according to the invention.

The decarburizing temperature and oxidation capacity (dew point, proportion of hydrogen) for achieving an underlying layer with good quality can be found in FIG. 2.

Example 4

Composition A in Table 2 and hot rolling condition C in Table 3 were combined to carry out normalization experiments. The effect of normalization process condition 1120° C.×5 s+910° C.×70 s+20° C./s, decarburizing condition 850° C.×200 s, dew point+60° C., as well as the proportion of nitrogen in protective atmosphere below 1000° C., dew point and time at the temperature rising stage of high-temperature annealing on magnetism is shown in Table 9.

TABLE 9

Relationship between atmosphere, time, dew point and magnetism

| Description | Temperature Holding Time at the First Stage (hr) | Proportion of Nitrogen in Protective Atmosphere below 1000° C. | Dew Point (° C.) | Nitrogen Increment (ppm) | $B_8$ (T) | $P_{17/50}$ (W/kg) |
|---|---|---|---|---|---|---|
| Comparative Example | 5 | 8% | 52 | 3 | 1.63 | 2.24 |

TABLE 9-continued

Relationship between atmosphere, time, dew point and magnetism

| Description | Temperature Holding Time at the First Stage (hr) | Proportion of Nitrogen in Protective Atmosphere below 1000° C. | Dew Point (° C.) | Nitrogen Increment (ppm) | $B_8$ (T) | $P_{17/50}$ (W/kg) |
|---|---|---|---|---|---|---|
| Inventive Example | 9 | 100% | 40 | 21 | 1.85 | 1.24 |
| Inventive Example | 12 | 90% | 30 | 27 | 1.90 | 1.05 |
| Inventive Example | 17 | 80% | 20 | 39 | 1.91 | 0.98 |
| Inventive Example | 21 | 40% | 10 | 29 | 1.87 | 1.12 |
| Inventive Example | 12 | 24% | −10 | 34 | 1.85 | 1.20 |
| Comparative Example | 3 | 10% | 40 | 7 | 1.81 | 1.51 |

Figure 3:
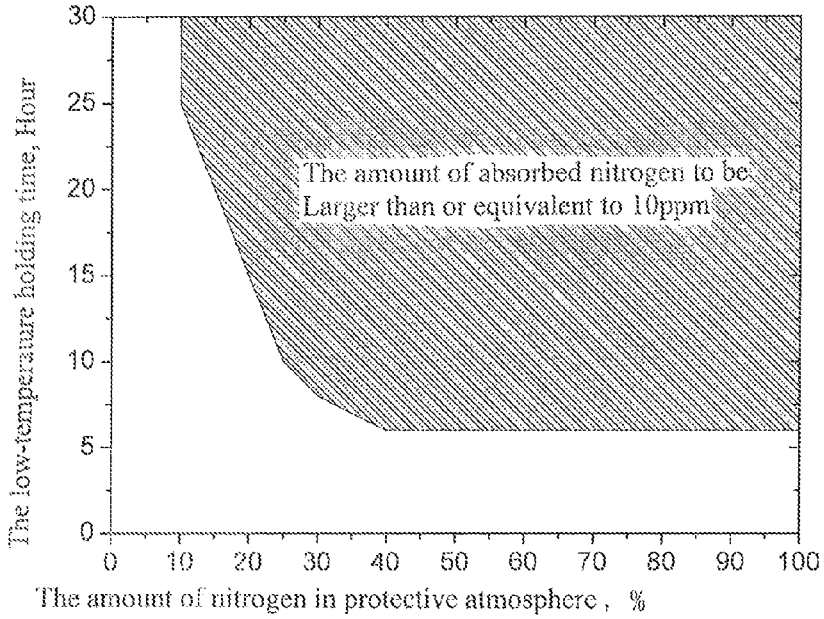
FIG. 3 is a schematic view showing the control of the amount of absorbed nitrogen to be larger than or equivalent to 10 ppm according to the invention.

FIG. 3 shows the effect of the proportion of nitrogen in protective atmosphere and the low-temperature holding time on the amount of absorbed nitrogen. Also given in the figure are the desirable conditions for high-temperature annealing when the amount of absorbed nitrogen is greater than or equivalent to 1 ppm. Good magnetism may be obtained in this case.

Example 5

Steel was smelted in a 500 kg vacuum furnace. The chemical compositions are shown in Table 10. The steel was hot rolled under condition C in Table 3. Subsequently, the hot rolled sheets were normalized according to 1150° C.×5 s+930° C.×70 s+35° C./s of cooling. Band steel was rolled to 0.30 mm, decarburized according to 850° C.×200 s, coated with MgO separator, subjected to high-temperature annealing and leveling annealing, coated with insulating coating and measured for magnetism. The results are presented in Table 10 too.

TABLE 10

Chemical compositions of inventive and comparative examples unit: wt %

| | C | Si | Mn | P | S | $Al_{sol.}$ | N | Cu | Sn | $B_8$ (T) | $P_{17/50}$ (W/kg) |
|---|---|---|---|---|---|---|---|---|---|---|---|
| 1 | 0.045 | 3.25 | 0.16 | 0.023 | 0.0063 | 0.027 | 0.0070 | 0.05 | 0.08 | 1.85 | 1.21 |
| 2 | 0.035 | 3.20 | 0.15 | 0.018 | 0.0054 | 0.028 | 0.0074 | 0.06 | 0.09 | 1.87 | 1.17 |
| 3 | 0.057 | 3.15 | 0.13 | 0.015 | 0.0070 | 0.020 | 0.0085 | 0.17 | 0.05 | 1.90 | 0.98 |
| 4 | 0.036 | 3.48 | 0.09 | 0.012 | 0.0066 | 0.018 | 0.0077 | 0.08 | 0.13 | 1.87 | 1.06 |
| 5 | 0.041 | 3.84 | 0.10 | 0.027 | 0.0075 | 0.021 | 0.0065 | 0.29 | 0.09 | 1.85 | 1.23 |
| 6 | 0.044 | 3.31 | 0.11 | 0.032 | 0.0094 | 0.022 | 0.0055 | 0.40 | 0.01 | 1.86 | 1.12 |
| 7 | 0.061 | 3.76 | 0.12 | 0.012 | 0.0053 | 0.034 | 0.0072 | 0.30 | 0.10 | 1.86 | 1.21 |
| 8 | 0.053 | 3.12 | 0.13 | 0.024 | 0.0082 | 0.026 | 0.0092 | 0.10 | 0.08 | 1.88 | 1.04 |
| 9 | 0.046 | 2.94 | 0.16 | 0.011 | 0.0075 | 0.018 | 0.0085 | 0.11 | 0.09 | 1.87 | 1.15 |
| 10 | 0.044 | 3.10 | 0.20 | 0.023 | 0.0035 | 0.018 | 0.0067 | 0.13 | 0.16 | 1.63 | 2.00 |
| 11 | 0.048 | 3.11 | 0.19 | 0.022 | 0.0043 | 0.019 | 0.0072 | 0.11 | 0.008 | 1.77 | 1.55 |
| 12 | 0.051 | 3.32 | 0.18 | 0.008 | 0.0190 | 0.022 | 0.0077 | 0.61 | 0.12 | 1.75 | 1.64 |
| 13 | 0.043 | 3.09 | 0.09 | 0.024 | 0.0140 | 0.018 | 0.0047 | 0.28 | 0.008 | 1.78 | 1.62 |
| 14 | 0.046 | 3.05 | 0.15 | 0.021 | 0.004 | 0.020 | 0.0070 | 0.66 | 0.13 | 1.70 | 2.03 |
| 15 | 0.033 | 4.11 | 0.19 | 0.025 | 0.0150 | 0.022 | 0.0081 | 0.45 | 0.13 | 1.74 | 1.65 |
| 16 | 0.045 | 2.87 | 0.19 | 0.021 | 0.0290 | 0.020 | 0.0086 | 0.48 | 0.14 | 1.67 | 1.88 |

* Inventive Example 1-9, Comparative Example 10-16.

Grain-oriented silicon steel has been produced by heating slab at high temperature since a long time ago, wherein slab is heated at a temperature up to 1400° C. to solid dissolve favorable inclusions, and subjected to high-temperature rolling after heated to obtain desirable distribution and size of the favorable inclusions. Primarily recrystallized grains are refrained during high-temperature annealing to obtain good secondary recrystallization microstructure. The drawbacks of this production method include:

(1) A special-purpose high-temperature heating furnace is a must.

(2) Due to heating at high temperature, (3) Slab with a general thickness in the range of 200-250 mm has to be heated for a long time before it is heated evenly, leading to high energy consumption.

(4) A lot of cylindrical crystals exist in slab, and oxidation occurs at crystal boundary. As a result, serious edge cracking is produced, leading to poor productive efficiency in subsequent procedures, low yield and high production cost.

These problems have been solved successfully by the method of the invention. In comparison with the methods of Japan, POSCO in South Korea, Acciai Speciali Terni Spa, etc., the method of the invention may control the primary recrystallization microstructure of steel sheet effectively via optimization of inhibitor size and crystal texture by normalization, and formation of additional favorable (Al, Si)N inclusions from nitrogen absorbed by steel sheet, facilitating the generation of stable, perfect secondary recrystallization microstructure of the final products. In addition, no special nitriding treatment is used in the method. Thus, there is no need for any nitriding apparatus, and formation of a good underlying layer is favored.

The technology for producing grain-oriented silicon steel by heating slab at low temperature stands at the developmental frontier of grain-oriented silicon steel. Devices used in the method of the invention are conventional devices for producing grain-oriented silicon steel. The method of the invention is simple and practical with promising prospect for wide application.

The invention claimed is:

1. A method for producing grain-oriented silicon steel with single cold rolling, comprising:

1) smelting:

after secondary refining and continuous casting of molten steel in a converter or an electric furnace, a casting blank having the following composition based on mass is obtained: C 0.035-0.065%, Si 2.9-4.0%, Mn 0.08-0.18%, S 0.005-0.012%, Als 0.015-0.035%, N 0.0050-0.0130%, Sn 0.001-0.15%, P 0.010-0.030%, Cu 0.05-0.60%, Cr≤0.2%, balanced by Fe and unavailable inclusions;

2) hot rolling:

the casting blank is heated to 1090-1200° C. in a heating furnace, rolling begins at a temperature below 1180° C. and ends at a temperature above 860° C., and a hot rolled steel sheet of 1.5-3.5 mm is thus obtained and then coiled at 500-650° C.;

3) normalization:

normalizing annealing is carried out at 1050-1180° C. (1-20 s)+850-950° C. (30-200 s), and cooling is carried out at 10° C./s-60° C./s;

4) cold rolling:

the steel sheet is rolled to a thickness of a final product with single cold rolling at a cold rolling reduction rate of 75-92%;

5) decarburization:

the steel sheet rolled to the thickness of the final product is decarburizing annealed at 780-880° C. for 80-350 s in a protective mixed gas atmosphere of $H_2$ and $N_2$ comprising 15-85% $H_2$, a dew point of the protective mixed gas atmosphere is 40-80° C., a total oxygen [O] in a surface of the decarburized steel sheet is 171/t≤[O]≤313/t (t represents an actual thickness of the steel sheet in mm), an amount of absorbed nitrogen is 2-10 ppm, then the sheet is coated with a high-temperature annealing separator comprising MgO as a main component;

6) high-temperature annealing:

a protective annealing atmosphere below 1000° C. is comprised of a mixed gas of $H_2$ and $N_2$ or pure $N_2$ and has a dew point of 0-50° C., a temperature holding time at a first stage is 6-30 h, an amount of absorbed nitrogen during high-temperature annealing is 10-40 ppm; and 7) hot leveling annealing:

a conventional hot leveling process is carried out, wherein at ¼-⅓ and ⅔-¾ of the thickness of the normalized steel sheet, a ratio of Gaussian texture (110)[001] to cubic texture (001)[110] is controlled to be $0.2 \leq I_{(110)[001]}/I_{(001)[110]} \leq 8$, wherein $I_{(110)[001]}$ and $I_{(001)[110]}$ are intensities of Gaussian and cubic texture respectively.

2. The method of claim 1 for producing grain-oriented silicon steel with single cold rolling, wherein based on the foregoing basic composition, into the grain-oriented silicon steel may be further added 0.01-0.10% Mo and/or ≤0.2% Sb based on mass.

3. The method of claim 1 for producing grain-oriented silicon steel with single cold rolling, wherein a number of crystal grains with Gaussian texture at ¼-⅓ and ⅔-¾ of the thickness of the normalized steel sheet is not less than 5% of a total number of crystal grains.

4. The method of claim 1 for producing grain-oriented silicon steel with single cold rolling, wherein the temperature holding time at the first stage for steel coil ≥5 tons is 8-15 h.

5. A method for producing grain-oriented silicon steel with single cold rolling, comprising:

1) smelting:

after secondary refining and continuous casting of molten steel in a converter or an electric furnace, a casting blank having the following composition based on mass is obtained: C 0.035-0.065%, Si 2.9-4.0%, Mn 0.08-0.18%, S 0.005-0.012%, Als 0.015-0.035%, N 0.0050-0.0130%, Sn 0.001-0.15%, P 0.010-0.030%, Cu 0.05-0.60%, Cr≤0.2%, balanced by Fe and unavailable inclusions;

2) hot rolling:

the casting blank is heated to 1090-1200° C. in a heating furnace, rolling begins at a temperature below 1180° C. and ends at a temperature above 860° C., and a hot rolled steel sheet of 1.5-3.5 mm is thus obtained and then coiled at 500-650° C.;

3) normalization:

normalizing annealing is carried out at 1050-1180° C. (1-20 s)+850-950° C. (30-200 s), and cooling is carried out at 10° C./s-60° C./s;

4) cold rolling:

the steel sheet is rolled to a thickness of a final product with single cold rolling at a cold rolling reduction rate of 75-92%;

5) decarburization:

the steel sheet rolled to the thickness of the final product is decarburizing annealed at 780-880° C. for 80-350 s in a protective mixed gas atmosphere of $H_2$ and $N_2$ comprising 15-85% $H_2$, a dew point of the protective mixed gas atmosphere is 40-80° C., a total oxygen [O] in a surface of the decarburized steel sheet is 171/≤[O]≤313/t (t represents an actual thickness of the steel sheet in mm), an amount of absorbed nitrogen is 2-10 ppm, then the sheet is coated with a high-temperature annealing separator comprising MgO as a main component;

6) high-temperature annealing:

a protective annealing atmosphere below 1000° C. is comprised of a mixed gas of $H_2$ and $N_2$ or pure $N_2$ and has a dew point of 0-50° C., a temperature holding time at a first stage is 6-30 h, an amount of absorbed nitrogen during high-temperature annealing is 10-40 ppm; and 7) hot leveling annealing:

wherein a ratio of Gaussian texture (110)[001] to cubic texture (001)[110] is controlled to be $0.5 \leq I_{(110)[001]}/I_{(001)[110]} \leq 2$.

6. The method of claim 5 for producing grain-oriented silicon steel with single cold rolling, wherein based on the foregoing basic composition, into the grain-oriented silicon steel may be further added 0.01-0.10% Mo and/or ≤0.2% Sb based on mass.

7. The method of claim 5 for producing grain-oriented silicon steel with single cold rolling, wherein a number of crystal grains with Gaussian texture at ¼-⅓ and ⅔-¾ of the thickness of the normalized steel sheet is not less than 5% of a total number of crystal grains.

8. The method of claim 5 for producing grain-oriented silicon steel with single cold rolling, wherein the temperature holding time at the first stage for steel coil ≥5 tons is 8-15 h.

* * * * *